United States Patent [19]

Yasukawa et al.

[11] 4,238,632

[45] Dec. 9, 1980

[54] ARC FURNACE FOR MAKING STEEL FROM DIRECTLY REDUCED IRON

[75] Inventors: Shozo Yasukawa, Yokosuka; Akinori Nakamura, Kamakura; Takamitsu Yamada, Yokohama, all of Japan

[73] Assignee: Ishikawajima-Harima Jukogyo Kabushiki Kaisha, Tokyo, Japan

[21] Appl. No.: 18,660

[22] Filed: Mar. 6, 1979

[30] Foreign Application Priority Data

Apr. 20, 1978 [JP] Japan ..... 53-52451[U]

[51] Int. Cl.[3] ..... F27D 1/00

[52] U.S. Cl. ..... 13/9 R; 13/32; 13/35

[58] Field of Search ..... 13/9, 9 R, 18 R, 32, 13/35

[56] References Cited

U.S. PATENT DOCUMENTS

| | | | |
|---|---|---|---|
| 1,234,836 | 7/1917 | Webb | 13/9 |
| 3,588,309 | 6/1971 | Yasukawa et al. | 13/9 X |
| 3,829,595 | 8/1974 | Nanjyo et al. | 13/32 |
| 4,021,603 | 5/1977 | Nanjyo et al. | 13/35 |

*Primary Examiner*—Roy N. Envall, Jr.
*Attorney, Agent, or Firm*—Alfred E. Miller

[57] ABSTRACT

An arc furnace for quickly and continuously melting directly reduced iron ore so as to make steel, wherein the furnace wall above the hearth line and the furnace roof have partly spherical inner surfaces, the spherical surface defining these inner surfaces having the center located adjacent to the point equidistantly spaced apart from the lower ends of electrodes, and the electrodes are inclined at an angle to the vertical so that the distance between the lower ends thereof may be reduced to a minimum.

3 Claims, 2 Drawing Figures

ARC FURNACE FOR MAKING STEEL FROM DIRECTLY REDUCED IRON

BACKGROUND OF THE INVENTION

The present invention relates to an arc furnace for quickly and continuously melting and refining directly reduced iron.

Especially in the countries rich with oils and iron ores, the construction of installations for directly reducing iron ores has been made independently of or in parallel with the installations for the continuous operation of iron and steel making from a blast furnace to converters. In case of the continuous operation of iron and steel making starting from the direct reduction of iron ores and having a capacity of more than 100 million tons per year, there has been an ever increasing strong demand for adoption of the process for quickly and continuously melting directly reduced iron in an arc furnace because of advantages with regards installation costs, operation costs, savings of energy and labor, maintenance etc.

Figure 1:
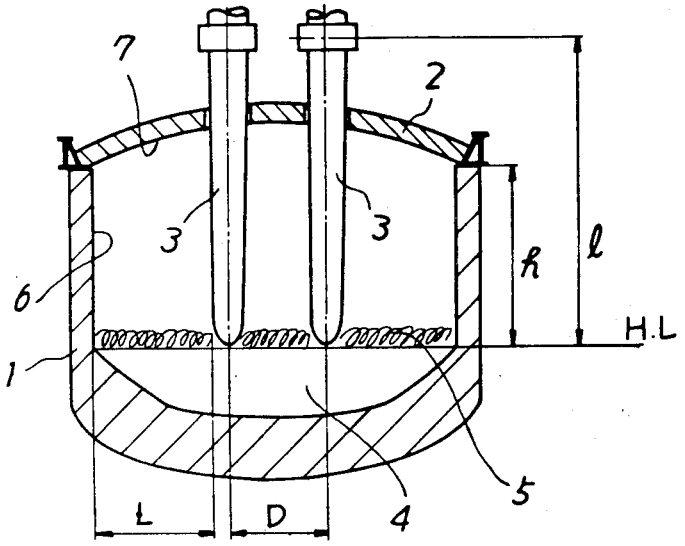
Fig. 1 PRIOR ART
Figure 2:
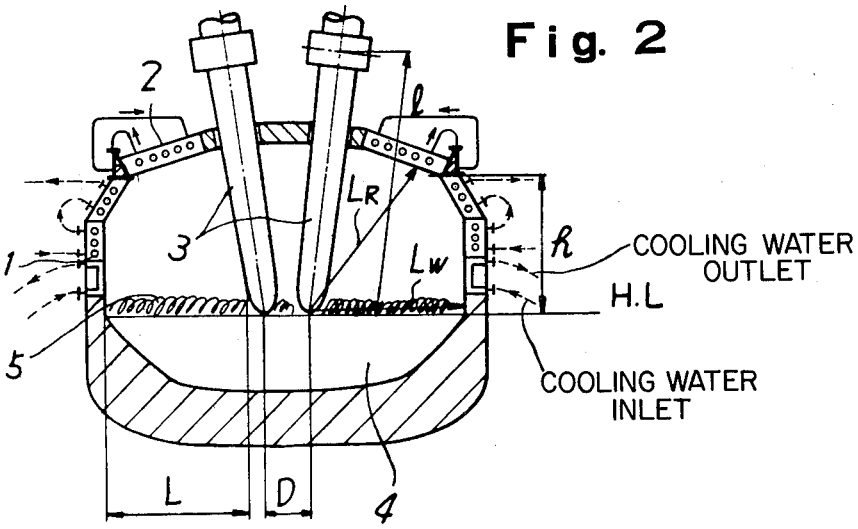

In order that the invention will be more clearly understood, it will now be disclosed in greater detail with reference to the accompanying drawings, in which:

FIG. 1 is a schematic sectional view of an arc furnace for continuously making steel from directly reduced iron and constituting prior art, and FIG. 2 is a schematic sectional view of an arc furnace for continuously making steel from directly reduced iron in accordance with the teachings of the present invention.

FIG. 1 shows a conventional arc furnace for continuously melting directly reduced iron, which comprises a furnace main body 1, a roof 2, electrodes 3 inserted into the furnace main body 1 through the roof 1, and refractory linings 6 and 7. A slag 5 floats over molten steel 4. h denotes the height above the hearth line H.L.; l, the length of the electrodes above the hearth line H.L.; D, the distance between the axes of the electrodes 3; and L, the horizontal distance from the peripheral surface of the electrode 3 to the lining 6 on the main body 1.

Effective refractory erosion index of the arc furnace with the above construction is given by $$R_{EP} = K\frac{P_P \cdot V_P}{L^2}$$

and the agitation force $F_H$ for stirring molten steel by arc plasmas is given by $$F_H = \alpha\frac{I_A^2}{V_P^n \cdot D^m}$$

where K=a constant obtained from experiments;

$P_P$=arc plasma power, MW/phase;

$V_P$=arc plasma voltage, V/phase;

$\alpha$=a constant obtained from experiments;

$I_A$=arc current, KA; and m and n=constants obtained from experiments.

It has been determined that the arc furnace of the type described above has following defects:

(1) Since the electrodes 3 are inserted vertically into the furnace main body 1, the distance D between the lower ends of the electrodes 3 is limited so that the distance L becomes shorter. As a result, with the arc plasma power $P_P$ and arc plasma voltage $V_P$ remaining unchanged, the effective refractory erosion index $R_{EP}$ becomes greater, resulting in the decrease in lifetime of the lining and in the increase in heat loss.

(2) Since the distance D becomes longer, the molten steel agitation force $F_H$ becomes low, resulting in the insufficient stirring of the slag, the molten steel and the directly reduced iron, and consequently adversely affecting the quick melting of directly reduced iron.

(3) In the case of the use of superpower arc furnaces, especially with $R_{EP} \gtrsim 300$ MW·V/m$^2$, the service life of refractory linings is considerably shortened at hot spot portions and at the slag line with the result of the reduction in operation efficiency. Thus, the operation of the arc furnace is adversely affected.

(4) In order to protect the refractory lining of the roof, the furnace height h must be increased. As a result, the length of electrodes is increased so that the impedance of the electrodes is increased. Thus, the fundamental characteristics of the arc furnace operation with superpower are adversely affected.

(5) Because of the long length l of the electrodes, oxidation of peripheral surfaces of electrodes is much enhanced, resulting in the increase in the unit cost of electrodes.

(6) Because of the increased height h of the furnace, refractory linings tend to be separated and to collapse. As a consequence, it is difficult to provide a furnace vessel roughly in the form of a pear by converging the upper portion of the vessel. As a result, the over-all surface area of refractory linings is increased, thus resulting in the increase in unit cost of refractory lining as well as in heat loss.

The present invention was made to overcome the above and other problems encountered in the conventional arc furnaces for making steel from directly reduced iron, and will become apparent from the following description of one preferred embodiment thereof taken in conjunction with FIG. 2 of the drawings.

Referring now to FIG. 2 in which the same reference numerals are used to designate similar parts shown in FIG. 1.

In order to reduce the distance D, it is desirable to install the electrodes 3 as closely as possible, but because of the limit to the space available at the top of the furnace, there exists the limit to the spacing between the electrodes 3 when installed vertically as shown in FIG. 1. In order to overcome this problem, according to the present invention, the electrodes 3 are inclined to the vertical at an angle between 2 and 6 degrees so that the distance D between the lower ends of the electrodes 3 may be reduced as practically as possible.

Cooling water passages (now shown) are constructed and arranged in both the furnace wall and the roof 2 so that more than about 70% of them may be suitably cooled. To this end, the furnace wall and the roof 2 are assembled from blocks.

The furnace wall and the roof 2 are so designed that their inner surfaces may be defined by a part of a spherical surface whose center is located adjacent to the point where the axes of electrodes 3 intersect the hearth line H.L. More particularly, let Lw denote the distance from the center to the lining surface 6 of the furnace wall and let $L_R$ the distance from the center to the lining surface 7 of the roof 2. Then $$L_R \approx L_w$$

Thus, the furnace height h above the hearth line is considerably decreased as compared with the conventional arc furnaces.

Directly reduced iron charged into the furnace is quickly and continuously melted into molten steel 4.

The arc furnace constructed in accordance with the present invention has the following features and advantages:

(1) The distance D between the lower ends of the electrodes is reduced to a minimum so that the distance L may be increased to a maximum and the super arc powers may be concentrated to the center of the furnace. As a result, lining wear coefficient $R_{EP}$ can be considerably reduced by about 25% as compared with the conventional arc furnaces and consequently the service life of linings can be increased by about 25%. Furthermore, the heat loss can be reduced to a minimum. These merits are reflected in the increase in production capacity of more than ten furnaces with a capacity between 40 and 120 tons.

(2) The reduction of the distance D to a minimum results in the increase by about 30% in the molten steel agitation force $F_H$ as compared with the conventional arc furnaces. That is, the agitation of directly reduced iron and molten steel is much enhanced so that the quick melting of directly reduced iron may be accelerated.

(3) More than 70% of the furnace wall above the hearth line as well as the roof are constituted of blocks which define the cooling water circulation passages. As a result, the service life of linings can be increased to more than 3,000 heatings. This means that the linings have a semi-permanent service life. Furthermore, the full use of super-arc-power may be permitted so that the production capacity (in terms of ton/hour/furnace) can be remarkably increased. In addition, the cost associated with linings may be considerably reduced. For instance, in case of the 43.2 MVA superpower arc furnace with a capacity of 60 tons, the production capacity is increased by about 20% while the lining cost is reduced by about more than 15% as compared with the conventional arc furnaces.

(4) In addition to the provision of the cooling water circulation system, the furnace height is decreased to a minimum and the furnace wall above the hearth line and the furnace roof have partly spherical inner surfaces. As a result, the elctrode length l can be reduced by more than 10% as compared with the conventional arc furnaces. Furthermore, the impedance of electrodes can be reduced by about 30% as compared with conventional arc furnaces because of the synergistic effect obtained from the reduction in distance D which in turn is attained by the inclination of electrodes.

(5) Since the furnace wall as well as the furnace roof have partly spherical inner surfaces as described above, the over-all lining surface area above the hearth line H.L. may be reduced by more than about 30% as compared with the conventional arc furnaces. Thus, the unit cost of linings may be considerably reduced and the thermal efficiency may be remarkably improved.

What is claimed is:

1. An arc furnace for rapidly and continuously melting directly reduced iron to make steel and having a roof, wall and hearth line comprising: at least two spaced electrodes mounted through the furnace roof and inclined toward each other at an angle to an imaginary vertical line therebetween so that the lower ends of said electrodes converge and are adjacent to each other, the inner surfaces of said furnace wall and roof above the hearth line together forming a segment of a circle whose center is located on said hearth line adjacent to the points where the axes of said electrodes intersect the hearth line, and wherein $L_R = L_W$, in which $L_R$ is the distance from said center to the lining surface of the roof, and $L_W$ is the distance from said center to the lining surface of the furnace wall.

2. An arc furnace as set forth in claim 1 wherein said furnace wall above said hearth line and said furnace roof are partly constituted of blocks which define cooling water circulation passages in said furnace wall and roof.

3. An arc furnace as set forth in claim 1 wherein said electrodes are inclined at an angle of from 2° to 6° to said imaginary vertical line.

* * * * *